US012007143B2

(12) United States Patent
Xu

(10) Patent No.: US 12,007,143 B2
(45) Date of Patent: Jun. 11, 2024

(54) HUMIDIFIER

(71) Applicant: RIMOO (FOSHAN) ELECTRICAL APPLIANCES TECHNOLOGY CO., LTD., Guangdong (CN)

(72) Inventor: Shijie Xu, Guangdong (CN)

(73) Assignee: RIMOO (FOSHAN) ELECTRICAL APPLIANGES TECHNOLOGY CO., LTD, Foshan (CN)

( * ) Notice: Subject to any disclaimer, the term of this patent is extended or adjusted under 35 U.S.C. 154(b) by 176 days.

(21) Appl. No.: 17/434,377

(22) PCT Filed: Oct. 31, 2019

(86) PCT No.: PCT/CN2019/114849
§ 371 (c)(1),
(2) Date: Aug. 26, 2021

(87) PCT Pub. No.: WO2020/177358
PCT Pub. Date: Sep. 10, 2020

(65) Prior Publication Data

US 2022/0128248 A1 Apr. 28, 2022

(30) Foreign Application Priority Data

Mar. 1, 2019 (CN) ..... 201910156327.0

(51) Int. Cl.
*F24F 6/12* (2006.01)
*F24F 11/88* (2018.01)
(Continued)

(52) U.S. Cl.
CPC ..... *F24F 6/12* (2013.01); *F24F 11/88* (2018.01); *F24F 13/20* (2013.01); *F24F 2006/008* (2013.01)

(58) Field of Classification Search
CPC .... F24F 6/12; F24F 11/88; F24F 13/20; F24F 2006/008; F24F 11/89; F24F 2013/205
See application file for complete search history.

(56) References Cited

U.S. PATENT DOCUMENTS 4,810,205 A * 3/1989 O'Grady ..... H01R 13/506 439/350
5,859,952 A * 1/1999 Levine ..... F24F 6/18 239/102.1

(Continued)

FOREIGN PATENT DOCUMENTS

CN 200986282 Y 12/2007
CN 109737539 A 5/2019

(Continued)

OTHER PUBLICATIONS

International Search Report of PCT/CN2019/114849.
Written Opinion of PCT/CN2019/114849.

*Primary Examiner* — Stephen Hobson

(57) ABSTRACT

The present disclosure relates to a humidifier, the humidifier including: a body, a tank, a blower, an atomizer, and a control module. The body is formed in the inside thereof with a first cavity used for receiving of the tank. The body is provided with an opening for the tank to enter and exit the first cavity. The body is also provided with a first air outlet. The blower and the control module are both arranged inside the body. The tank is provided with a second air outlet communicating with the first air outlet and an air intake communicating with an air exit of the blower. The atomizer is arranged in the tank. The atomizer is electrically connected to a first joint of the control module via a power cord passing through the tank.

4 Claims, 3 Drawing Sheets

(51) Int. Cl.
*F24F 13/20* (2006.01)
*F24F 6/00* (2006.01)

(56) References Cited

U.S. PATENT DOCUMENTS 6,244,576 B1* 6/2001 Tsai ..... F24F 6/02 261/DIG. 65
6,592,107 B1* 7/2003 Wong ..... F24F 6/02 392/404
10,168,064 B1* 1/2019 Zhang ..... F24F 6/12
2002/0163090 A1* 11/2002 Chu ..... F24F 6/02 261/81
2003/0169588 A1* 9/2003 Kohn ..... F21V 33/0088 362/253
2004/0108604 A1* 6/2004 Pan ..... F24F 6/00 261/26
2005/0067723 A1* 3/2005 Parker ..... F24F 6/043 261/104
2005/0200031 A1* 9/2005 Campbell ..... F24F 6/02 261/119.1
2006/0118977 A1* 6/2006 Huang ..... F24F 6/00 261/DIG. 65
2007/0035044 A1* 2/2007 Chiu ..... B05B 17/0615 261/81
2007/0104469 A1* 5/2007 Kang ..... H05B 3/46 392/324
2007/0217771 A1* 9/2007 Granger ..... A01M 1/2033 392/386
2008/0054497 A1* 3/2008 Bradley ..... A61M 16/167 261/19
2012/0234166 A1* 9/2012 Markham ..... F24F 6/18 95/149
2012/0319311 A1* 12/2012 Nutter ..... A61L 9/20 250/437
2015/0054183 A1* 2/2015 Chen ..... F24F 13/00 261/150
2016/0022954 A1* 1/2016 Bath ..... A61B 5/4836 128/203.12
2016/0123613 A1* 5/2016 Kim ..... F24F 6/12 261/78.2
2016/0265795 A1* 9/2016 Kopp ..... B01F 23/20
2017/0234599 A1* 8/2017 Dong ..... F24F 3/1405 62/93
2017/0304861 A1* 10/2017 Seo ..... B05B 17/0646
2017/0336086 A1* 11/2017 Lin ..... A61M 16/109
2018/0073769 A1 3/2018 Herweck et al.
2018/0093283 A1* 4/2018 Ford ..... B05B 3/022
2018/0100666 A1* 4/2018 Park ..... F24F 6/04
2018/0135875 A1* 5/2018 Seo ..... F24F 13/08
2018/0147594 A1* 5/2018 Kim ..... F24F 6/12
2018/0202672 A1* 7/2018 Seo ..... F24F 13/20
2018/0283712 A1* 10/2018 French ..... F04D 29/705
2019/0049133 A1* 2/2019 Cai ..... A61L 9/015
2019/0063768 A1* 2/2019 Chen ..... F24F 11/88
2019/0072289 A1* 3/2019 Lai ..... B01F 23/20
2019/0309967 A1* 10/2019 Seo ..... F24F 6/00
2020/0103140 A1* 4/2020 Davis ..... F24F 3/14
2020/0271338 A1* 8/2020 Kajiyama ..... F24F 6/04
2020/0284451 A1* 9/2020 Yang ..... F24F 6/02
2020/0340694 A1* 10/2020 Yang ..... F24F 6/12
2022/0120456 A1* 4/2022 Liu ..... F24F 6/14
2022/0154951 A1* 5/2022 Li ..... F24F 13/20
2022/0268461 A1* 8/2022 Seo ..... F24F 8/22
2023/0102678 A1* 3/2023 Xing ..... F24F 1/0083 62/291
2023/0112576 A1* 4/2023 Liu ..... G06N 3/047 706/15

FOREIGN PATENT DOCUMENTS

CN 209639190 U 11/2019
JP 2016217626 A 12/2016
KR 101697714 B1 1/2017
WO 2019009544 A1 1/2019
WO WO-2020199576 A1 * 10/2020

* cited by examiner

HUMIDIFIER

CROSS-REFERENCE TO RELATED APPLICATIONS

This Application is a national stage application of PCT/CN2019/114849. This application claims priorities from PCT Application No. PCT/CN2019/114849, filed Oct. 31, 2019, and from the Chinese patent application 201910156327.0 filed Mar. 1, 2019, the content of which are incorporated herein in the entirety by reference.

TECHNICAL FIELD

The disclosure relates to the technical field of household appliances, in particular to a humidifier.

BACKGROUND

With the development of economy and the improvement of people's living standards, people's requirements for quality of life and health are getting higher and higher. In this way, air humidifiers have slowly entered many households around the world, and have become an indispensable small household appliance for households in dry areas.

Conventional humidifiers are covered with water vapor every time they are used. After a long period of deposition, dirt will form inside the body. However, the conventional humidifiers cannot be cleaned or are difficult to disassemble and clean, and bacteria will grow inside the body over time, producing peculiar smell and reducing indoor air quality.

SUMMARY

In view of this, it is necessary to address the above technical problems and provide a humidifier, which has a detachable structure, which can be detached and cleaned, and thus effectively maintains the cleanliness of the inside of the body.

In order to achieve the above objective, the present disclosure provides a humidifier, the humidifier including: a body, a tank, a blower, an atomizer, and a control module. The body is formed in the inside thereof with a first cavity used for receiving of the tank. The body is provided with an opening for the tank to enter and exit the first cavity. The body is also provided with a first air outlet. The blower and the control module are both arranged inside the body. The tank is provided with a second air outlet communicating with the first air outlet and an air intake communicating with an air exit of the blower. The atomizer is arranged in the tank. The atomizer is electrically connected to a first joint of the control module via a power cord passing through the tank.

Compared with the background technology, the above humidifier has at least the following beneficial effects: after the humidifier is used, the tank can be taken out from the opening of the body, and after the tank is taken out, just unplug the power cord from the first joint of the control module, and the inside of the tank can be cleaned. The operation is simple, and the cleanliness of the inside of the humidifier is effectively maintained to prevent the growth of bacteria.

In one of the embodiments, the tank is provided with a first sleeve along a circumferential direction of the second air outlet, and the first sleeve is configured to be sleeved in the first air outlet.

In one of the embodiments, the body is provided with a second sleeve along an axial direction of the first air outlet, and the second sleeve can be sleeved with the first sleeve.

In one of the embodiments, a partition is provided in the body. The second sleeve is sleeved with the first sleeve after passing through the partition. The space between the partition and an inner wall of the body is closed to form a second cavity, and the control module is arranged in the second cavity.

In one of the embodiments, one end of the power cord is electrically connected to the atomizer, and the other end of the power cord is provided with a second joint for plugging into the first joint. The second joint is fixedly installed on the tank and corresponds to the position of the first joint.

In one of the embodiments, the tank is provided with an installation port corresponding to the position of the first joint of the control module, and the second joint is detachably connected to the installation port.

In one of the embodiments, the installation port is communicated with the air inlet, the installation port is provided with first clamping grooves on both sides thereof, and the second joint is provided with first clamping strips on both sides thereof. The first clamping strips are clamped into the first clamping grooves from a communication port between the installation port and the air intake.

In one of the embodiments, the top of the tank is detachably provided with a cover, and the second air outlet and the air intake are both provided on the cover.

In one of the embodiments, the tank is provided along an inner circumferential wall thereof with a second clamping groove, and the cover is provided along an outer circumference with a second clamping strip that cooperates with the second clamping groove, or, the tank is provided along an inner circumferential wall thereof with a third clamping strip, and the cover is provided along an outer circumference with a third clamping groove that cooperates with the third clamping strip.

In one of the embodiments, the opening is provided at the bottom of the body.

Figure 1:
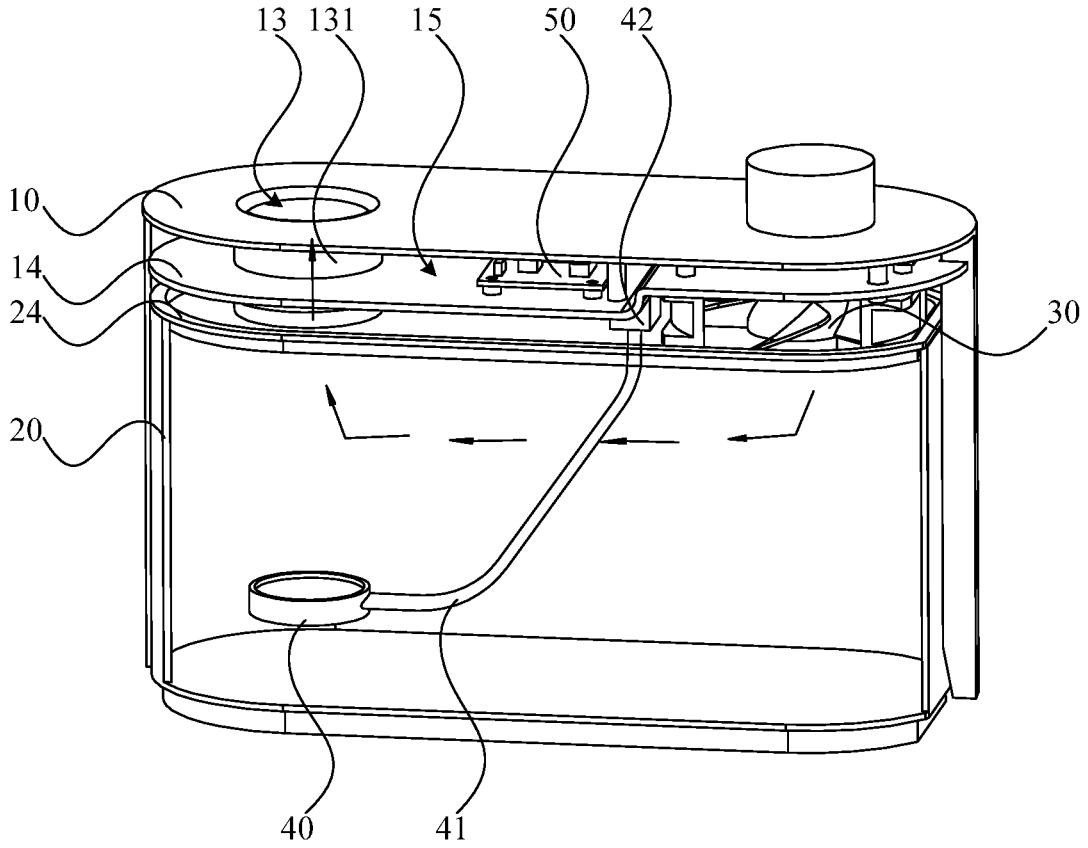
FIG. 1 is a schematic structural view of a humidifier according to an embodiment of the present disclosure.

10 body, 11 first cavity, 12 opening, 13 first air outlet, 131 second sleeve, 14 partition, 15 second cavity, 20 tank, 21 air intake, 22 first sleeve, 23 installation port, 24 cover, 30 blower, 40 atomizer, 41 power cord, 42 second joint, 50 control module

DETAILED DESCRIPTION OF THE EMBODIMENTS

In order to facilitate the understanding of the present disclosure, the present disclosure will be described more fully below with reference to the relevant drawings. Preferred embodiments of the present disclosure are shown in the drawings. However, the present disclosure can be implemented in many different forms and is not limited to the embodiments described herein. On the contrary, the purpose of providing these embodiments is to make the disclosure of the present disclosure more thorough and comprehensive.

It should be noted that when an element is referred to as being "fixed to" another element, it can be directly fixed to the other element or an intermediate element may also be present. When an element is referred to be "connected" to another element, it can be directly connected to the other element or an intermediate element may be present. In contrast, when an element is referred to as being "directly fixed on" another element, there are no intermediate elements. The "first" and "second" in the present disclosure do not represent a specific number and order, but are only used to distinguish names.

Figure 2:
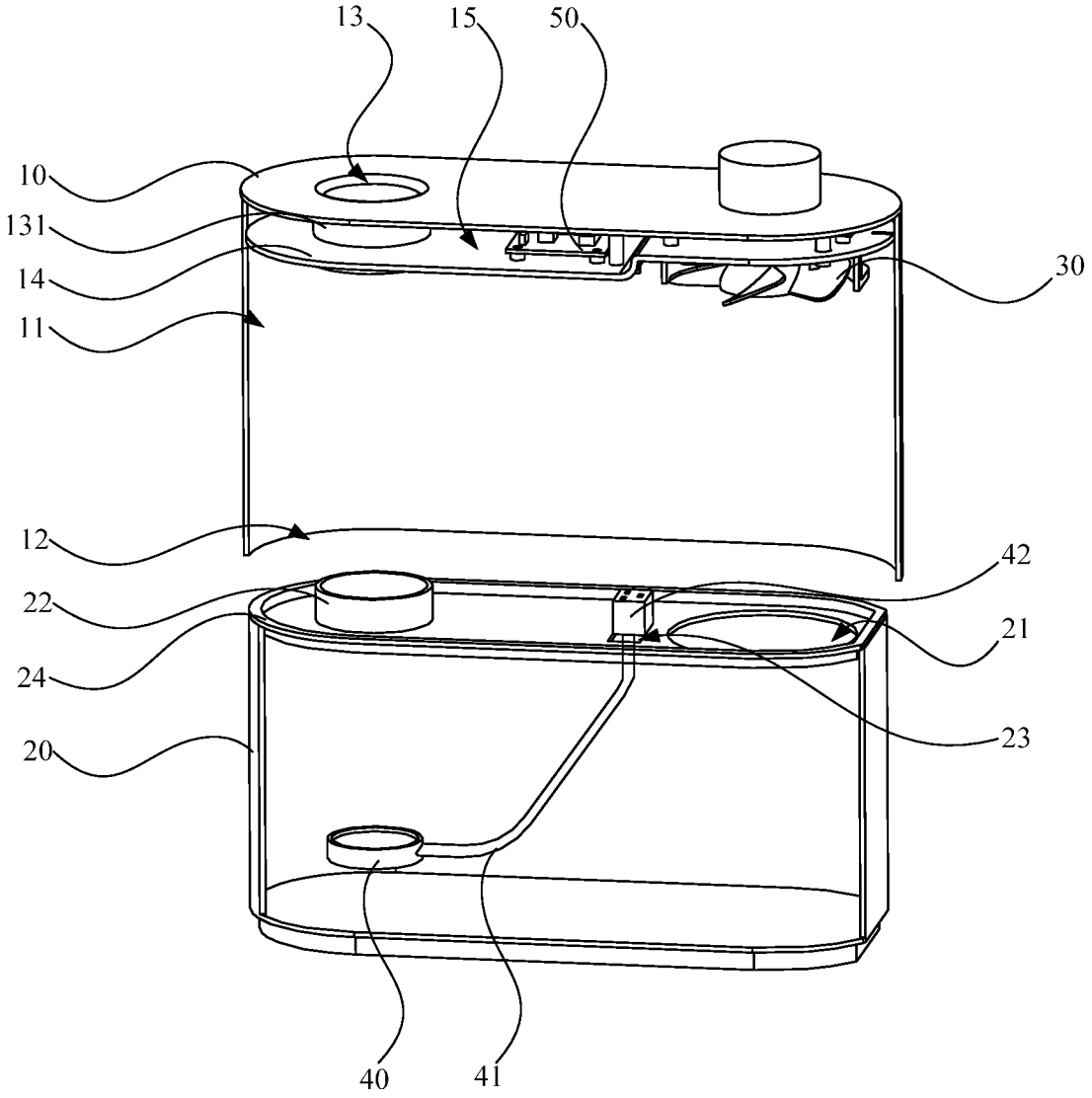
FIG. 2 is an exploded view of the humidifier shown in FIG. 1.

As shown in FIGS. 1 and 2, a humidifier includes: a body 10, a tank 20, a blower 30, an atomizer 40, and a control module 50. The body 10 is formed in the inside thereof with a first cavity 11 used for receiving of the tank 20. The body 10 is provided with an opening 12 for the tank 20 to enter and exit the first cavity 11. The body 10 is also provided with a first air outlet 13. The blower 30 and the control module 50 are both arranged inside the body 10. The tank 20 is provided with a second air outlet (not shown in the figures) communicating with the first air outlet 13 and an air intake 21 communicating with an air exit of the blower 30. The atomizer 40 is arranged in the tank 20. The atomizer 40 is electrically connected to a first joint (not shown in the figures) of the control module 50 via a power cord 41 passing through the tank 20.

It should be noted that in FIG. 1, the direction indicated by the arrow is the direction of water vapor flow inside the humidifier. Specifically, the air blows out from the air exit of the blower 30 and enters the tank 20 from the air intake 21 of the tank 20, driving the water vapor in the tank 20 to flow through the second air outlet and the first air outlet 13 in sequence and be discharged to the outside.

The first air outlet 13 corresponds to the position of the second air outlet, and the air intake 21 corresponds to the position of the air exit of the blower 30.

Referring to FIG. 2, after the humidifier is used, the tank 20 can be taken out from the opening 12 of the body 10, and after the tank 20 is taken out, just unplug the power cord 41 from the first joint of the control module 50, and the inside of the tank 20 can be cleaned. The operation is simple, and the cleanliness of the inside of the humidifier is effectively maintained to prevent the growth of bacteria.

In an embodiment, referring to FIGS. 1 and 2, the tank 20 is provided with a first sleeve 22 along a circumferential direction of the second air outlet, and the first sleeve 22 is configured to be sleeved in the first air outlet 13. Since the first sleeve 22 is sleeved in the first air outlet 13, the sealing between the body 10 and the tank 20 is strengthened, preventing water vapor from leaking into the inner space of the body 10, which prevents water vapor from accumulating in the inner space of the body 10, thereby preventing bacteria breeding, and can also prevent damaging of the electrical circuits inside the body 10 by water vapor.

Further, referring to FIG. 1, the body 10 is provided with a second sleeve 131 along an axial direction of the first air outlet 13, and the second sleeve 131 can be sleeved with the first sleeve 22. Since the second sleeve 131 is sleeved with the first sleeve 22, the sealing between the body 10 and the tank 20 is further strengthened, thereby preventing water vapor from leaking into the internal space of the body 10.

In an embodiment, referring to FIGS. 1 and 2, a partition 14 is provided in the body 10. The second sleeve 131 is sleeved with the first sleeve 22 after passing through the partition 14. The space between the partition 14 and an inner wall of the body 10 is closed to form a second cavity 15, and the control module 50 is arranged in the second cavity 15. By providing the partition 14, the water vapor can be effectively isolated outside the second cavity 15, which can prevent the water vapor from contacting the control module 50 and cause damage to the circuit of the control module 50, thereby improving the reliability of the humidifier.

In an embodiment, referring to FIG. 2, one end of the power cord 41 is electrically connected to the atomizer 40, and the other end of the power cord 41 is provided with a second joint 42 for plugging into the first joint. The second joint 42 is fixedly installed on the tank 20 and corresponds to the position of the first joint. When the tank 20 needs to be installed into the body 10, the tank 20 is sleeved into the body 10 from the opening 12 until the second joint 42 and the first joint are plugged with each other, and the installation is convenient and quick.

In an embodiment, referring to FIGS. 1 and 2, the tank 20 is provided with an installation port corresponding to the position of the first joint of the control module 50, and the second joint 42 is detachably connected to the installation port 23. When cleaning the tank 20, first remove the second joint 42 from the tank 20, and then take out the atomizer, the power cord 41 and the second joint 42 from the tank 20 to facilitate the cleaning of the tank 20. The detachable connection structure herein can be of multiple types, such as a clamping buckle connection structure or a clamping groove/strip connection structure. It should be noted that the second joint 42 completely covers the installation port 23 to prevent water vapor from leaking from the installation port 23 to the inside of the body 10.

Figure 3:
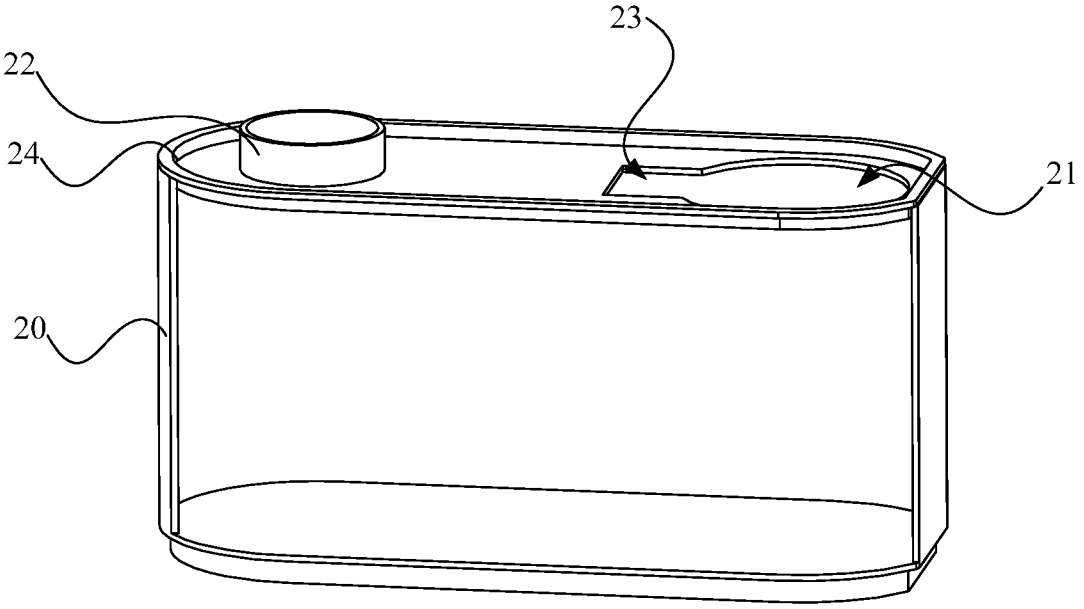
FIG. 3 is a schematic structural view of another embodiment of the tank of the humidifier shown in FIG. 1.

Specifically, referring to FIG. 3, the installation port 23 is communicated with the air inlet 21, the installation port 23 is provided with first clamping grooves (not shown in the figures) on both sides thereof, and the second joint 42 is provided with first clamping strips (not shown in the figures) on both sides thereof. The first clamping strips are clamped into the first clamping grooves from a communication port between the installation port 23 and the air intake 21. The above arrangement facilitates the disassembly and assembly operations of the second joint 42 and makes the cleaning of the tank 20 more convenient.

In an embodiment, the top of the tank 20 is detachably provided with a cover 24, and the second air outlet and the air intake 21 are both provided on the cover 24. When cleaning the tank 20, the cover 24 can be taken out of the tank 20 first, so that the cleaning operation of the tank 20 is more convenient and the cleaning is more thorough.

Specifically, the tank 20 is provided along an inner circumferential wall thereof with a second clamping groove (not shown in the figures), and the cover 24 is provided along an outer circumference with a second clamping strip (not shown in the figures) that cooperates with the second clamping groove, or, the tank 20 is provided along an inner circumferential wall thereof with a third clamping strip (not shown in the figures), and the cover 24 is provided along an outer circumference with a third clamping groove (not shown in the figures) that cooperates with the third clamping strip. The above detachable structure is relatively simple, which is beneficial to reduce the production cost of the humidifier. Of course, other forms of detachable structures, such as a clamping buckle structure or a threaded structure, can also be adopted between the cover 24 and the tank 20.

In an embodiment, the opening 12 is provided at the bottom of the body 10. When the tank 20 needs to be disassembled, all needs to be done is just lifting up the body 10 and pulling out the power cord 41. When the tank 20 needs to be installed, all needs to be done is just plugging the power cord 41 into the first joint, and inserting the tank 20 into the first cavity 11 of the body 10, which makes the disassembly and assembly operation more convenient.

The technical features of the above embodiments can be combined arbitrarily. In order to make the description concise, all possible combinations of the various technical features in the above embodiments are not described. However, as long as there is no contradiction in the combination of these technical features, they all should be considered as within the scope of the present disclosure.

The above embodiments only show several embodiments of the present disclosure, and the descriptions are relatively specific and detailed, but they should not be interpreted as limiting the scope of the disclosure. It should be pointed out that for those skilled in the art, several modifications and improvements can be made without departing from the concept of the present disclosure, and these shall all fall within the protection scope of the present disclosure. Therefore, the protection scope of the present disclosure is subject to the appended claims.

What is claimed is:

1. A humidifier comprising:

a body comprising a first cavity and a second cavity, a partition, a first air outlet and an opening provided at the bottom of the body, a tank, wherein the top of the tank is detachably provided with a cover, a second air outlet and an air intake are both provided on the cover; and the tank enters and exits the first cavity via the opening, a blower comprising an air exit and disposed in the second cavity, an atomizer, a control module comprising a first joint and disposed in the second cavity, and a power cord, wherein one end of the power cord is electrically connected to the atomizer and the other end of the power cord is provided with a second joint for plugging into the first joint, the second joint is fixedly installed on the tank and corresponds to the position of the first joint, the second joint is detachably connected to an installation port that is provided with the tank and corresponds to the position of the first joint of the control module, and the second joint completely covers the installation port to prevent water vapor from leaking from the installation port to the inside of the body, wherein the body is formed in the inside thereof with the first cavity used for receiving of the tank, and the body is provided with an opening for the tank to enter and exit the first cavity, the body is also provided with the first air outlet, and the blower and the control module are both arranged inside the body, the tank is provided with a second air outlet communicating with the first air outlet and the air intake communicating with the air exit of the blower, and the atomizer is arranged in the tank, and the atomizer is electrically connected to the first joint of the control module via the power cord passing through the tank, the air blows out from the air exit of the blower and enters the tank from the air intake of the tank, driving water vapor in the tank to flow through the second air outlet and the first air outlet in sequence and be discharged to the outside; and the partition is disposed between the top of the body and the top of the tank, the second cavity is formed between the partition and an inner wall of the body, and the control module is arranged in the second cavity; by providing the partition, the water vapor can be effectively isolated outside the second cavity, which can prevent the water vapor from contacting the control module and cause damage to the circuit of the control module, thereby improving the reliability of the humidifier;

the tank is provided with a first sleeve along a circumferential direction of the second air outlet, and the first sleeve is configured to be sleeved in the first air outlet;

the body is provided with a second sleeve along an axial direction of the first air outlet, and the second sleeve is sleeved with the first sleeve after passing through the partition; since the second sleeve is sleeved with the first sleeve, the sealing between the body and the tank is further strengthened, thereby preventing water vapor from leaking into the second cavity of the body;

when the tank needs to be installed into the body, the tank is sleeved into the body from the opening until the second joint and the first joint are plugged with each other;

after the humidifier is used, the tank is configured to be taken out from the opening of the body, and after the tank is taken out, the power cord is unplugged from the first joint of the control module, and the inside of the tank can be cleaned;

when cleaning the tank, the second joint is first removed from the tank, and the atomizer, the power cord and the second joint are taken out from the tank to facilitate the cleaning of the tank.

2. The humidifier according to claim 1, wherein the tank is provided with the installation port corresponding to the position of the first joint of the control module, and the second joint is detachably connected to the installation port.

3. The humidifier according to claim 2, wherein the installation port is communicated with the air inlet, and the installation port is provided with first clamping grooves on both sides thereof, and wherein the second joint is provided with first clamping strips on both sides thereof, and the first clamping strips are clamped into the first clamping grooves from a communication port between the installation port and the air intake.

4. The humidifier according to claim 3, wherein the tank is provided along an inner circumferential wall thereof with a second clamping groove, and the cover is provided along an outer circumference with a second clamping strip that cooperates with the second clamping groove, or, the tank is provided along an inner circumferential wall thereof with a third clamping strip, and the cover is provided along an outer circumference with a third clamping groove that cooperates with the third clamping strip.

* * * * *